US010450103B2

(12) United States Patent
Hundeloh et al.

(10) Patent No.: US 10,450,103 B2
(45) Date of Patent: Oct. 22, 2019

(54) LID FOR A BEVERAGE CAN

(71) Applicant: IMV Innovation Marketing und Vertriebs GmbH, Cologne (DE)

(72) Inventors: Thomas Hundeloh, Bad Marienberg (DE); Andreas Umbreit-Pluta, Schwulper (DE); Matthias Nagel, Thum (DE)

(73) Assignee: IMV INNOVATION MARKETING UND VERTRIEBS GMBH, Cologne (DE)

( * ) Notice: Subject to any disclaimer, the term of this patent is extended or adjusted under 35 U.S.C. 154(b) by 0 days.

(21) Appl. No.: 15/572,209

(22) PCT Filed: May 3, 2016

(86) PCT No.: PCT/EP2016/059942
§ 371 (c)(1),
(2) Date: Nov. 7, 2017

(87) PCT Pub. No.: WO2016/177754
PCT Pub. Date: Nov. 10, 2016

(65) Prior Publication Data

US 2018/0148219 A1 May 31, 2018

(30) Foreign Application Priority Data

May 7, 2015 (DE) ..... 10 2015 208 558

(51) Int. Cl.
*B65D 17/28* (2006.01)
*B21D 51/38* (2006.01)

(52) U.S. Cl.
CPC ..... *B65D 17/4012* (2018.01); *B21D 51/383* (2013.01); *B65D 17/404* (2018.01);
(Continued)

(58) Field of Classification Search
CPC ..... B65D 17/4012; B65D 17/4011; B65D 17/401; B65D 17/28; B65D 17/404; B21D 51/383; B21D 51/38
(Continued)

(56) References Cited

U.S. PATENT DOCUMENTS 3,254,790 A * 6/1966 Dunn ..... B65D 17/4011 220/270
3,964,633 A 6/1976 Zundel
(Continued)

FOREIGN PATENT DOCUMENTS

| | | |
|---|---|---|
| EP | 1590252 | 3/2011 |
| GB | 2432825 | 6/2007 |
| WO | WO 99/16676 | 4/1999 |

OTHER PUBLICATIONS

International Search Report for International Patent Application No. PCT/EP2016/059942, dated Aug. 17, 2016, 4 pages.
(Continued)

*Primary Examiner* — Robert J Hicks
(74) *Attorney, Agent, or Firm* — Viering, Jentschura & Partner mbB

(57) ABSTRACT

The invention relates to a lid consisting of metal for a beverage can, which lid is designed to be permanently connected to a can body and has a lid panel in which a rivet for a grip tab is formed and in which a predetermined breaking line defining a breaking-open area is impressed, along which line an opening in the lid panel can be opened by the grip tab, wherein a rivet base, which has resulted from a formation of the rivet, is present around the rivet, within which base the metal of the lid is thinner and/or more brittle than in adjoining regions of the lid panel.

16 Claims, 8 Drawing Sheets

(52) U.S. Cl.
CPC ..... *B65D 2517/0014* (2013.01); *B65D 2517/0077* (2013.01)

(58) Field of Classification Search
USPC ..... 220/269, 270, 272, 268, 266, 265, 906; 413/14, 12, 8
See application file for complete search history.

(56) References Cited

U.S. PATENT DOCUMENTS 3,967,752 A * 7/1976 Cudzik ..... B65D 17/4012 220/269
5,031,264 A * 7/1991 Muster ..... B65D 51/245 15/104.93
6,059,137 A * 5/2000 Westwood ..... B65D 17/166 220/258.2
6,161,717 A * 12/2000 Forrest ..... B65D 17/165 220/269
6,889,862 B2 * 5/2005 Vaughan ..... B65D 17/165 220/269
7,500,577 B2 * 3/2009 Wichelhaus ..... B65D 17/4014 220/254.4
7,666,487 B2 * 2/2010 Kubo ..... B32B 1/02 428/43
2010/0193519 A1 * 8/2010 Forrest ..... B65D 17/4012 220/272
2012/0082529 A1 4/2012 Blei et al.
2012/0205378 A1 * 8/2012 Forrest ..... B65D 17/404 220/269
2016/0039565 A1 * 2/2016 Gatewood ..... B65D 17/4012 53/492

OTHER PUBLICATIONS

Translation of International Search Report for International Patent Application No. PCT/EP2016/059942, dated Aug. 17, 2016, 2 pages.
Written Opinion for International Patent Application No. PCT/EP2016/059942, dated Aug. 17, 2016, 5 pages.

* cited by examiner

Section A-A

Detail B

Spin clip stand

Circle Variant

Rectangle variant

Arc variant

LID FOR A BEVERAGE CAN

CROSS REFERENCE TO RELATED APPLICATIONS

This application is a national stage application under 35 U.S.C. 371 of PCT Application No, PCT/EP2016/059942, having an international filing date of May 3, 2016, which designated the United States, which PCT application claimed the benefit of German Patent Application No. 10 2015 208 558.9, tiled on May 7, 2015, both of which are incorporated by reference in their entirety.

The invention relates to a lid made of metal, in particular aluminum, for a beverage can or the like, which is designed for permanent connection to a can body and has a lid panel, out of which a rivet is formed, as well as a predetermined breaking line, which defines a breaking-open area, is impressed in this lid panel, an opening in the lid panel being openable along this predetermined breaking line by means of a grip tab, which is attached to the rivet and has a break-open edge, which is pressed against a predetermined pressing point of the breaking-open area by lifting a grip section of the grip tab when the opening is opened, the metal of the lid being thinner and/or more brittle here than in the areas of the lid panel adjacent to the rivet base.

Such lids are sufficiently well-known from the usual beverage cans. Beverage cans typically have a one-piece can body made of sheet metal with a permanently attached lid also made of sheet metal. The body of the can and the lid are typically connected to one another by means of a double seam.

The lid itself is typically made in two pieces and has a lid plate, also known as a shell, and a grip tab used to open a breaking-open area in the shell.

The shell typically has a central lid panel surrounded by a peripheral reinforcing bead (counter sink), which is in turn enclosed on its exterior side by a chuck wall. The breaking-open area is arranged in the area of the lid panel and is defined by the predetermined breaking line, which is impressed in the lid as a narrow scratch. Depending on the embodiment of the predetermined breaking lines, their cross-sectional profiles may be different. In most cases, a rivet is provided exactly at the center of the lid panel and outside of the breaking-open area, said rivet being formed from the lid panel, to which the grip tab is typically attached in a pivotable manner.

The grip tab typically has a fastening section with an opening, into which the rivet formed from the lid panel protrudes. A grip section, which is to be gripped with one's fingers and thereby raised, is provided on one side of the fastening section. An opener section is typically provided on the side of the fastening section opposite the grip section, its edge facing away from the rivet to serve as a break-open edge and to press on the breaking-open area in the lid panel when the grip section is raised in the opener position of the grip tab. The break-open edge typically presses on a predetermined pressing point of the breaking-open area close to a section of the predetermined breaking line adjacent to the rivet, wherein the predetermined pressing point of the breaking-open area is predetermined by the length of the opener section above the breaking-open area, so that the predetermined breaking line comes open first in the immediate vicinity of the rivet and opens further only with further lifting of the grip section until it has finally torn along its full length and the breaking-open area releases an opening in the lid panel.

The initial opening of the predetermined breaking line may be supported by the fact that the predetermined breaking line in the vicinity of the rivet typically runs through a region of the lid panel, which is referred to as the rivet base and is formed by sheet metal that is thinner and preferably embrittled and is formed by the shaping of the rivet.

Under some circumstances, however, it may be desirable for the section of the predetermined breaking line close to the rivet to be a greater distance away from the rivet than is usually the case. One reason for this may be that a sealing section should still remain between the predetermined breaking line and the rivet. In these cases, the distance between the predetermined breaking line and the rivet may be so great that the predetermined breaking line no longer runs through the rivet base, i.e., it no longer runs through sheet metal material that has been thinned and embrittled as a result of the shaping of rivet. This makes the initial breaking open of the predetermined breaking line more difficult. Furthermore, the lever ratios are also less favorable because the break-open edge of the opener section of the grip tab is a greater distance away from the rivet than is the case with the usual lids for beverage cans.

The object of the present invention is to create a lid for beverage cans which can be opened reliably even when the distance of the predetermined breaking line from the rivet is greater.

According to the invention, this object is achieved by a lid of the type defined in the introduction, in which the predetermined breaking line is outside of the rivet base and preferably runs at a distance from the rivet base, and an embossment, which also runs outside of the rivet base, is preferably a distance away from the rivet base and causes the material to be thinner, this embossment being provided in at least one lid panel area situated between the rivet base and the predetermined pressing point of the breaking-open area, wherein a longitudinal section of the predetermined breaking line in the lid panel area overlaps with the material-thinning embossment along the longitudinal section, wherein the embossing depth of the predetermined breaking line is greater than the embossing depth of the material-thinning embossment.

Embrittlement of the sheet metal material of the lid, which has been thinned out by the embossment, is preferably also associated with such a material-thinning embossment, shaped in the form of an embossing recess, so that the initial breaking open of the predetermined breaking line is facilitated in the area where the predetermined breaking line overlaps with the material-thinning embossment, and the greatest bending stresses in the sheet metal material are transferred between the rivet and the pressing point of the breaking-open area, where the sheet metal material is pressed down when the drinking opening is opened by the breakaway edge of the grip tab.

One advantage of the invention is that the longitudinal section of the predetermined breaking line can overlap with the material-thinning embossment precisely at the location where an initial breaking open of the predetermined breaking line is desired, i.e., very close to the pressing point of the breaking-open area, where the break-open edge of the grip tab presses on the breaking-open area in order to open the drinking opening defined by the predetermined breaking line. Since the material-thinning embossment preferably has no other purpose than to facilitate the breaking open of the predetermined breaking line, the design of the material-thinning embossment can be optimized precisely for this purpose, for example, in terms of its width and depth.

The predetermined breaking line preferably runs at the ends of the longitudinal section, which overlaps the material-thinning embossment, out of the overlap with the material-thinning embossment.

The predetermined breaking line is preferably pressed into the material-thinning embossment along the longitudinal section of the predetermined breaking line and along a longitudinal section of the material-thinning embossment, which is preferably designed as a flat groove, and the predetermined breaking line runs out of the material-thinning embossment at the ends of the longitudinal section. In this embodiment, in which the cross-sectional contour of the predetermined breaking line extends through the bottom area of the material-thinning embossment and into the thinned metal material adjacent to the bottom area, the embossing stamp for the predetermined breaking line therefore presses through the bottom surface into the metal material, the structure of which has been altered by the embossing of the material-thinning embossment. In this way, microcracks may develop in this area and may contribute to easy breaking of the predetermined breaking line in this area.

The material-thinning embossment preferably runs in a curve shape at least partially around the rivet base, which is formed as a result of the shaping of the rivet. The material-thinning embossment is preferably designed in the form of a ring and arranged concentrically around the rivet. This embodiment variant has the advantage that the stress distribution in the metal material is more uniform around the rivet base.

Alternatively, however, the material-thinning embossment may also be in the form of a crescent-shaped section partially around the rivet or in the form of a tangent to a circle running around the rivet.

The grip section of the grip tab is preferably designed so that it can serve as a closure for the opening which is formed after breaking open the breaking-open area. To do so, the grip tab can preferably be rotated around the rivet, so that the grip section of the grip tab can be moved beyond the respective opening formed by breaking open the predetermined breaking line. Such a grip tab is described in EP 1 590 252, for example.

The predetermined breaking line is preferably pressed into the material-thinning embossment along the longitudinal section and preferably exits from the material-thinning embossment at the ends of the longitudinal section.

The material-thinning embossment preferably has a greater width than the predetermined breaking line in a direction running radially to the rivet.

The material-thinning embossment has a width, which is preferably greater than the width of the predetermined breaking line, measured in the radial direction emanating from the rivet. This width of the material-thinning embossment preferably amounts to between 0.6 millimeter and 1 millimeter and may be wider than the corresponding width of the predetermined breaking line. Depending on the geometry used for the cross-sectional contour of the embossment, which serves as the predetermined breaking line, however, the width of the upper subsection of the predetermined breaking line may be the same as or even slightly greater than the width of the material-thinning embossment.

The material-thinning embossment may have a depth that is at least an approximately uniform over at least a certain minimum width, i.e., the residual thickness of the sheet metal material in the region of the material-thinning embossment is at least approximately the same over this minimum width, so the result is a flat bottom of the material-thinning embossment. Alternatively, the cross-sectional contour of the material-thinning embossment may also be in a different shape, for example, it may be designed as a flat, rounded trough in preferred embodiments, so that a flat, rounded bottom surface of the material-thinning embossment is formed outside of the area of overlap with the predetermined breaking line.

The longitudinal section of the predetermined breaking line, which overlaps with the material-thinning embossment along its length and preferably along a length section of the groove-shaped embossment may have a straight course or a curved course, for example, wherein the convex side of the curve may face the rivet. This longitudinal section is preferably curved and faces the rivet with its concave side. A great overlapping length of the predetermined breaking line with the material-thinning embossment may be favorable in order for the breaking of the predetermined breaking line to continue more easily in the predetermined breaking line after the line has been broken open, starting at the breaking point, when the breaking section is pressed down to a greater extent by the break-open edge of the grip tab. The radius of curvature of the curved longitudinal section of the predetermined breaking line may be greater than the radius of curvature of a curved material-thinning embossment.

The center line of the material-thinning embossment is preferably a distance (radius) of between 4 millimeters and 4.5 millimeters away from the central axis of the rivet, i.e., in the case of a circle described by the center line around the rivet, the diameter of the circle is 8 to 9 millimeters.

The material-thinning embossment preferably runs in a curved form at least partially around the rivet base. From the rivet base, such an area of the lid panel around the rivet is formed, in which the sheet metal material of the lid panel is thinner and preferably more brittle than that in the areas of the lid panel adjacent to the rivet base around the rivet base.

With a material thickness of the sheet metal material of 0.21 millimeter to 0.25 millimeter, for example, 0.23 millimeter, the embossing depth of the material-thinning embossment preferably amounts to 0.03 millimeter to 0.05 millimeter and is thus in the preferred range of the embossing depth of 15% to 25% of the material thickness, so this yields a residual wall thickness of 0.18 millimeter to 0.2 millimeter, for example. The embossing depth of the predetermined breaking line here preferably amounts to 0.12 millimeter to 0.14 millimeter.

The material-thinning embossment is preferably introduced into the lid panel from the outside (i.e., from the exterior side, which faces away from what will become the interior of the can) so that the result is a small recess on this exterior side of the lid (the customer side of the lid). The predetermined breaking line is typically also impressed in the lid panel from the customer side (the exterior side of lid).

Alternatively, the material-thinning embossment may also be impressed in the lid panel from the inside (the product side), which will later face the interior of the beverage can, whereas again in this case, the predetermined breaking line is preferably impressed in the lid panel from the exterior side.

The rivet is preferably arranged outside of the breaking-open area.

The rivet is preferably not arranged centrally on the lid panel but instead is offset in the direction of the edge of the lid panel where the breaking-open area is located.

Furthermore, the rivet is preferably arranged on a bead running around the breaking-open area and serving to reinforce the edge of the breaking-open area and the future drinking opening. This facilitates closing of the drinking opening of the grip section of the grip tab, wherein the edge of the drinking opening is reinforced accordingly by the peripheral bead. Accordingly, the edge of the longitudinal section of the predetermined breaking line, which overlaps with the material-thinning embossment and faces the rivet, is also reinforced to prevent sagging, with the initial depression of the breaking-open area at the pressing point, so as to further facilitate easy opening of the predetermined breaking line.

The predetermined breaking line and at least the section of the material-thinning embossment which overlaps with the longitudinal section of the predetermined breaking line preferably run at the level of the remaining lid panel.

To solve the problem defined in the introduction, a method for manufacturing a lid according to the aforementioned type contributes toward the solution; in this method, the shaping of the rivet comprises the following steps:

forming a bubble initial forming a rivet head, and second forming of a rivet head.

In such a method, the material-thinning embossment is preferably introduced into the lid panel only during the shaping of the second rivet head from the (exterior) side of the lid, such that the lid panel, in which the predetermined breaking line is subsequently impressed, and to which the grip tab is subsequently attached, is introduced into its lid panel. The rivet base around the rivet, which is formed as a result of the shaping of the rivet and in which the material of the shell is thinner and/or more brittle than in regions of the lid panel adjacent to the rivet base, is preferably formed during the formation of the bubble and/or the shaping of the first rivet head.

Alternatively, the material-thinning embossment may also be created in the lid simultaneously with the predetermined breaking line, in which case the predetermined breaking line is then introduced from the (exterior) side of the lid into the lid panel, to which the grip tab is subsequently attached (customer side), while the material-thinning embossment is impressed in the lid from the other side (interior side or product side) facing the contents of the can.

The invention will now be explained in greater detail on the basis of exemplary embodiments with reference to the figures in the drawings.

Of the figures:

FIG. 1*a* shows a lid according to the invention, including the grip tab, in a view from above;

FIG. 1*b* shows a cross-sectional contour of the lid according to the sectional line A-A in FIG. 1 when opening the drinking opening;

Figure 5:
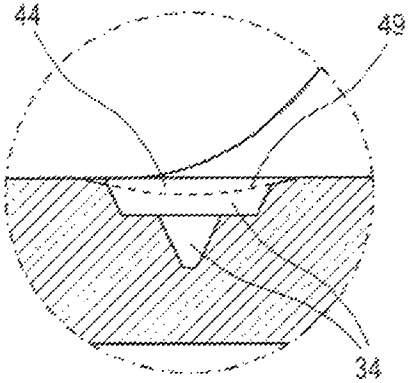
FIG. 5 shows a detail B of the section A-A from FIG. 4 with an enlarged diagram of the material-thinning embossment and the predetermined breaking line superimposed thereon.
Figure 3:
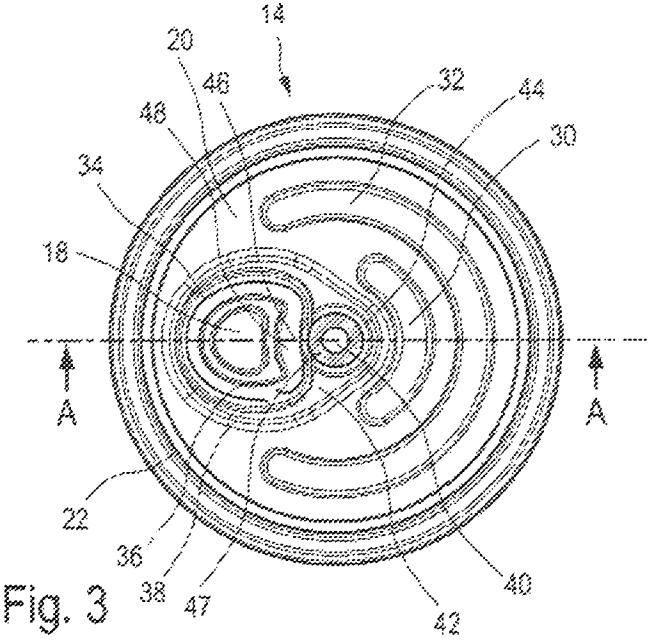
FIG. 3 shows a top view of the shell from FIG. 2.
Figure 6A:
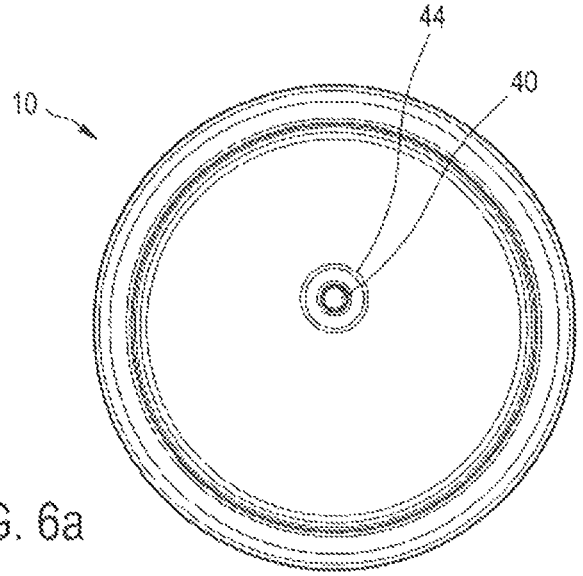
Figure 7A:
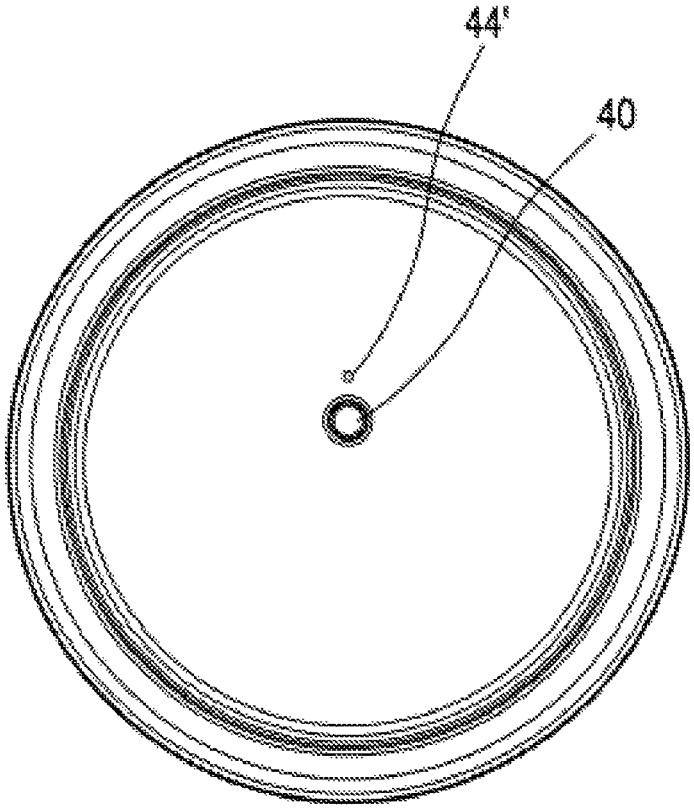
Figure 8A:
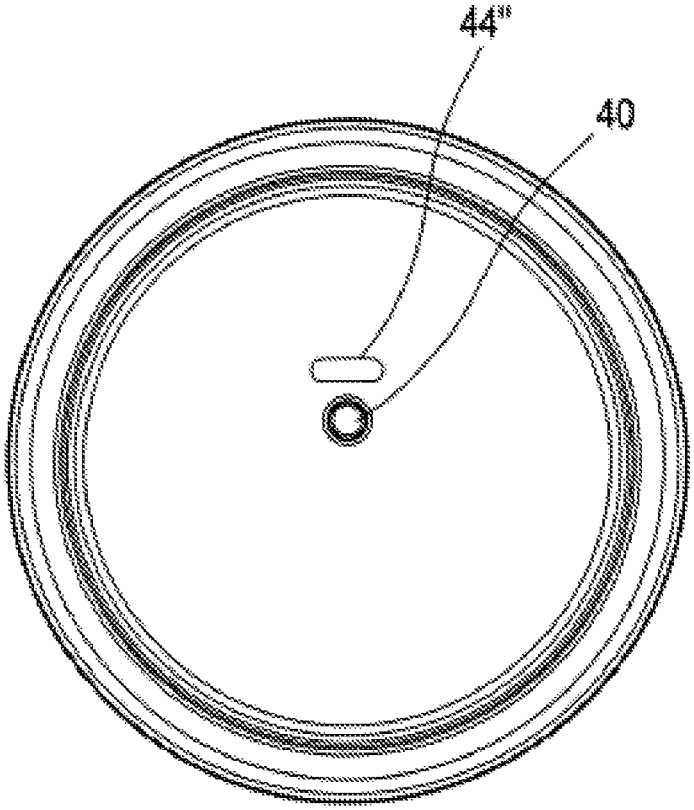
Figure 9A:
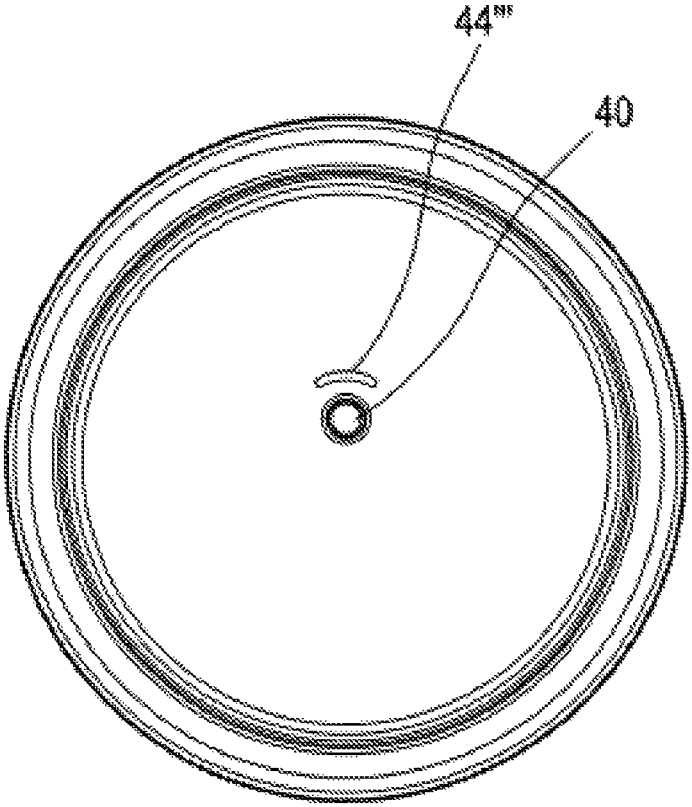
Figure 10B:
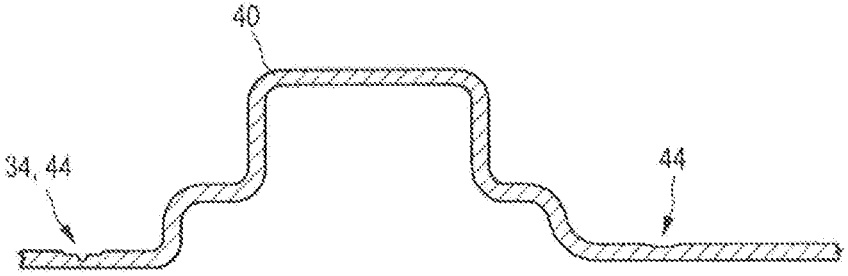
Figure 10A:
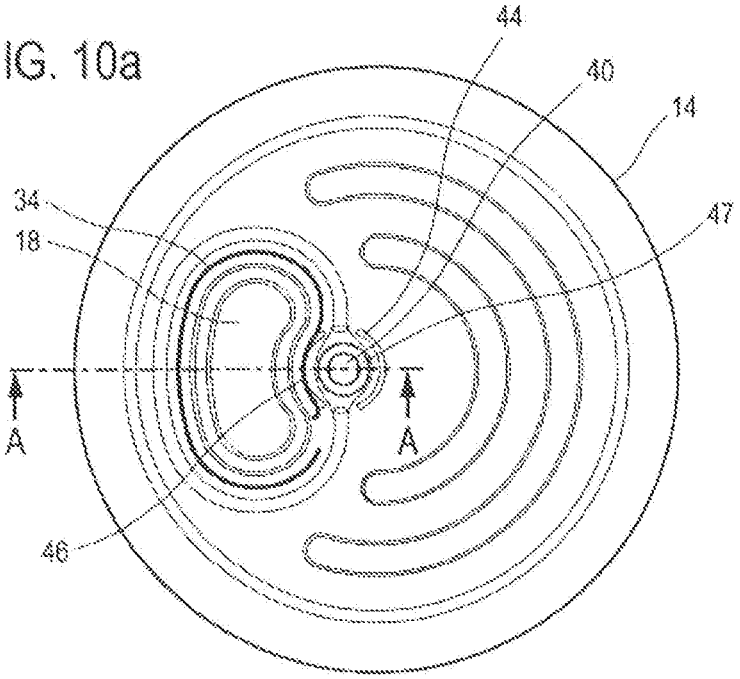

FIGS. 6*a*+6*b* a perspective diagram as well as a top view of a blank of the shell with a preferred variant of the material-thinning embossment, such as that used with the shell from FIGS. 2 through 5;

FIGS. 7*a*+7*b* show a perspective view and a top view of a blank of the shell with an alternative variant of a material-thinning embossment;

FIGS. 8*a*+8*b* show a perspective diagram and a top view of a blank of the shell with an additional alternative variant of a material-thinning embossment;

FIGS. 9*a*+9*b* show a perspective diagram and a top view of a blank of the shell with a third variant of a material-thinning embossment;

FIG. 10*a* shows a top view of a shell like that in FIG. 3 in a different embodiment; and FIG. 10*b* shows an enlarged portion of section A-A from FIG. 10*a* with a sectional diagram of the predetermined breaking line and the material-thinning embossment.

Figure 1A:
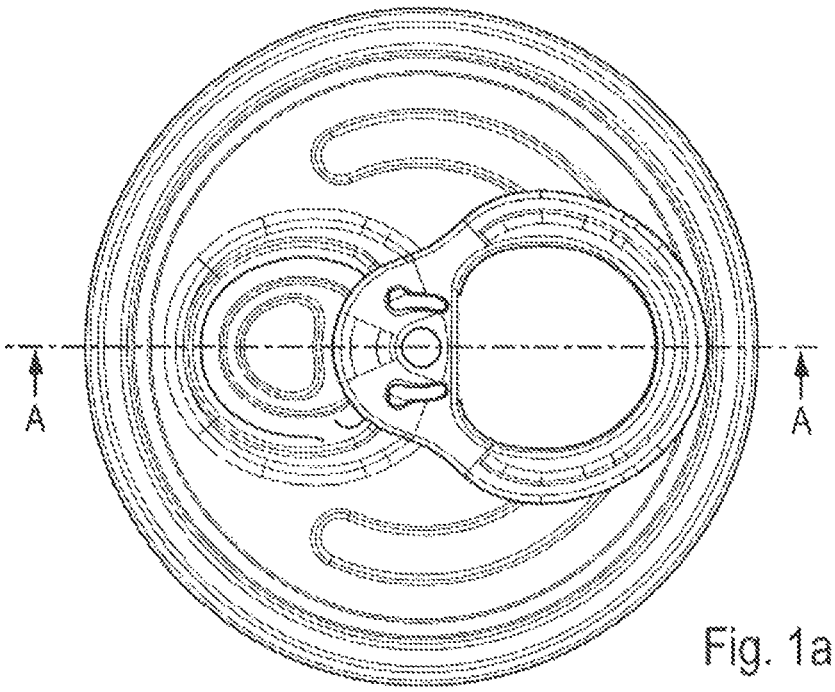

FIG. 1*a* shows a lid made of sheet metal, in particular aluminum, having a roll 12 for a subsequent connection to a can body (not shown). The lid 10 is connected to the can body by means of a double seam in the area of the roll 12.

The lid 10 is in two parts and has a shell 14 and a grip tab 16. A breaking-open area 18 in the shell 14 can be broken open by means of the grip tab 16, so that a drinking opening is formed, for example.

FIGS. 2 through 5 show the shell 14 of the lid 10 in detail.

Like the usual lids, the lid 10 has a central panel 20 surrounded by a peripheral counter sink 22. The peripheral counter sink 22 is in turn encompassed by chuck wall 24, which develops into the roll 12. The chuck wall 24 has a peripheral protrusion 26 facing inward and serving to provide a locking hold down of a fee end of a grip section 28 of the grip tab 16, which serves as the closure for the drinking open when the tab is rotated over the resulting drinking opening after the breaking-open area 18 has been opened.

Reinforcing recesses 30 and 32 and shaped in the panel 20, reinforcing the panel 20 outside of the opening system shaped into the panel.

The opening system is formed by the breaking-open area 18, which is defined by a predetermined breaking line 34 and is reinforced by an annular protrusion 36 shaped into it. Furthermore, the breaking-open area 18 is surrounded by a head 38, which protrudes beyond the level of the remaining panel and serves to reinforce the edge strip of the sheet metal material surrounding the predetermined breaking line 34 as well as the periphery of the drinking opening, which is formed after breaking open the breaking-open area 18.

A rivet 40 is arranged on a plateau 42 formed by the protruding bead 38 at the center of panel 20. The rivet 40 serves to fasten the grip tab 16 on the shell 14 and is arranged outside of the breaking-open area 18.

Figure 1B:
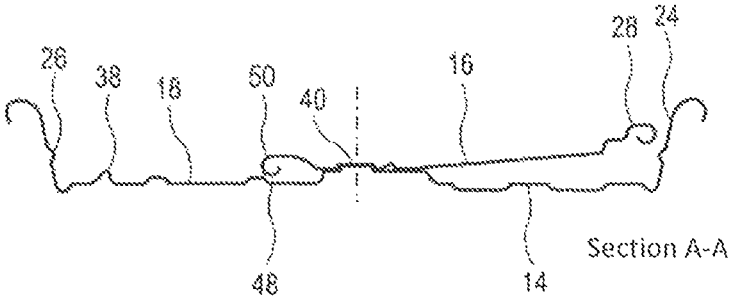
Figure 2:
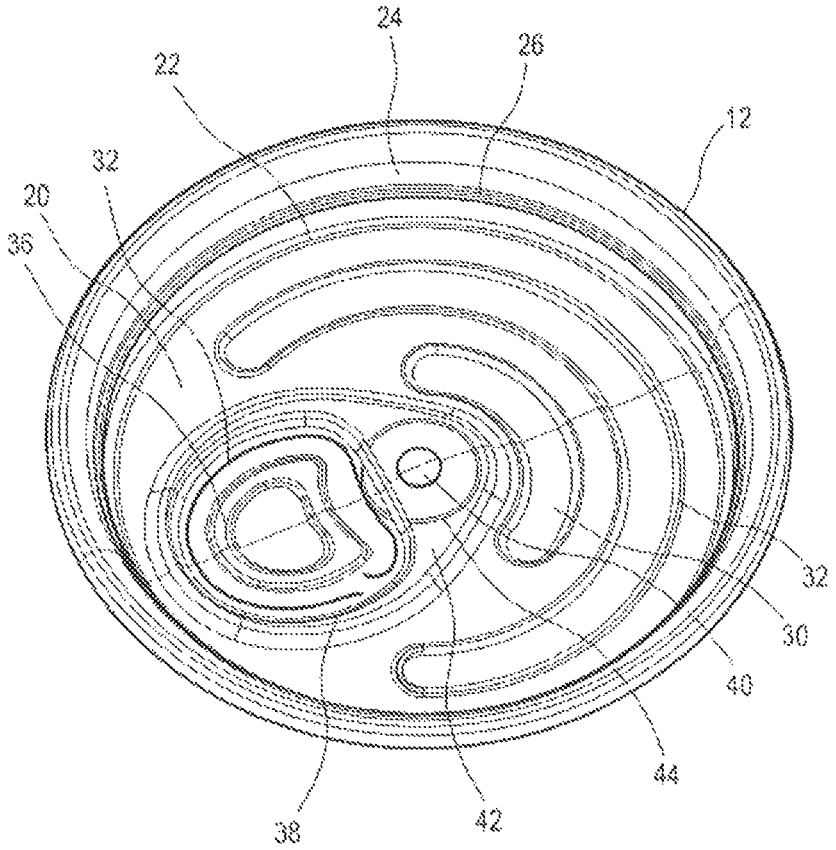
FIG. 2 shows a perspective diagram of a shell for the lid from FIG. 1.
Figure 4:
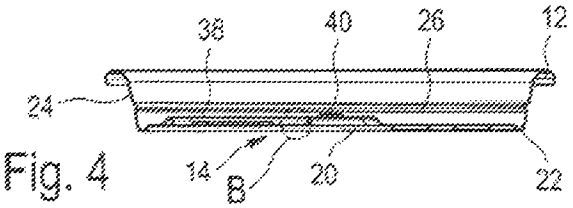
FIG. 4 shows a section A-A through the shell from FIG. 3.

FIG. 1*b* shows a cross-sectional contour of the lid along the sectional line A-A in FIG. 1*a* wherein the grip tab 16 is in a position for opening the breaking-open area 18 by lifting the grip section 28 of the grip tab. The grip tab 16 is attached pivotably to the rivet 40 by means of a fastening section, so that the opener section of the grip tab can be pivoted away together with its break-open edge 50. Therefore, the break-open edge is pressed onto a pressing point 48 of the breaking-open area 18, which is situated next to the rivet 40, so that the predetermined breaking line, which is mostly adjacent to the breaking-open area, is broken open and the breaking-open area which has now been separated is pivoted into the resulting drinking open by further lifting of the grip section.

FIG. 3 shows that the panel has a so-called rivet base 47 around the rivet 40, forming a region around the rivet due to the fact that the rivet 40 has been shaped out of the shell 14 so that the sheet metal surrounding the rivet 40 has become thinner and more brittle in the rivet base 47 than the remaining sheet metal material of the shell 14. The material-thinning embossment 40 which runs concentrically around the rivet 40 in the form of an annular groove or ridge is introduced into the exterior surface of the shell 14 outside of the rivet base and at a distance therefrom, and the width of this annular groove or ridge is somewhat larger on the exterior surface than the width of the scratch forming the predetermined breaking line 34.

The material-thinning embossment 44 is arranged and of dimensions such that the predetermined breaking line 34 runs through the bottom surface 49 (illustrated with a broken line in FIG. 5) of the material-thinning embossment 44 in its longitudinal section 46 next to the rivet 40, also running outside of the rivet base and at a distance therefrom. This ensures that the predetermined breaking line 34 will run close to the rivet 40 through the thinned and embrittled sheet metal material, which facilitates the initial breaking open of the predetermined breaking line 34 in this section. The predetermined breaking line 34 is at a distance in the range of 4 to 4.5 millimeters from the central axis of the rivet 40. As shown in FIG. 5, the material-thinning embossment has the cross-sectional contour of a flat rounded trough with an embossing depth in the range of approx. 20% of the thickness of the sheet metal material. In the area of the width of the material-thinning embossment the remaining sheet metal thickness of the sheet metal material of the lid 10 amounts to approx. 0.18 millimeter to 0.2 millimeter. However, the cross-sectional contour of the predetermined breaking line 34 has an embossing depth of 0.12 to 0.14 millimeter.

The width of the material-thinning embossment (measured in the radial direction starting from the rivet) preferably amounts to between 0.6 millimeter and 1 millimeter.

FIGS. 6 through 9 show various alternative embodiment variants of a material-thinning embossment according to the invention.

FIGS. 6 through 9 show blanks of the shell after shaping the rivet and impressing the material-thinning embossment but before shaping the other design features of the shell and before embossing the predetermined breaking line. Therefore, only the respective rivet 40 and the material-thinning embossment 44 are shown in the region of the respective panel 20. However, the other features of the opening system are not shown.

Figure 6B:
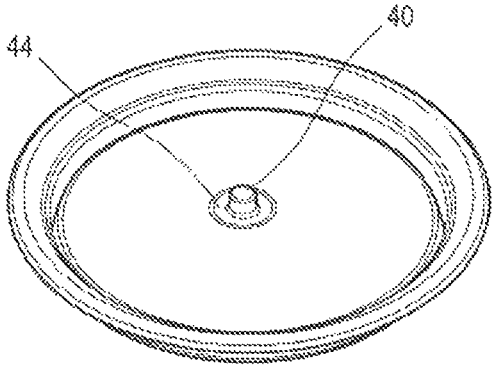

The embodiment variant in FIGS. 6*a* and 6*b* corresponds to the embodiment variant according to FIGS. 2 through 5, in which the rivet 40 is arranged so that it is offset from the center of the panel 20, and in which the material-thinning embossment 44 is in the form of a ring that is concentric with the rivet 40 and completely surrounds the rivet 40.

Figure 7B:
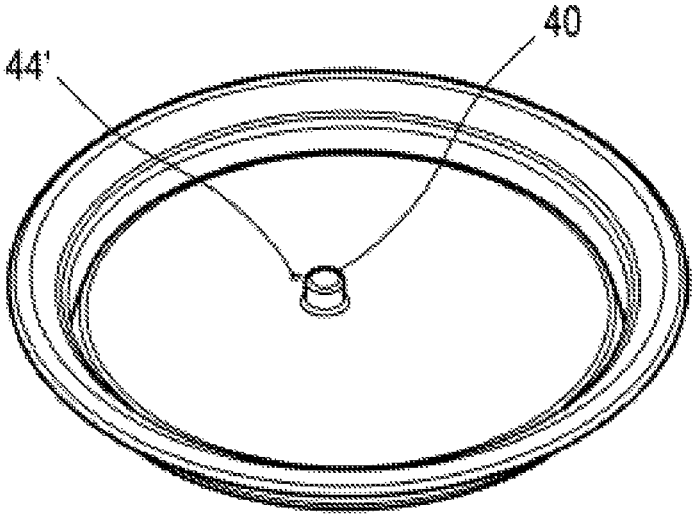

In the embodiment variant illustrated in FIGS. 7*a* and 7*b*, the material-thinning embossment 44' is in the form of a small circular area whose midpoint is the same distance from the central axis of the rivet 40 as the center line of the ring-shaped material deepening embossment 44 in FIGS. 6*a* and 6*b*.

Figure 8B:
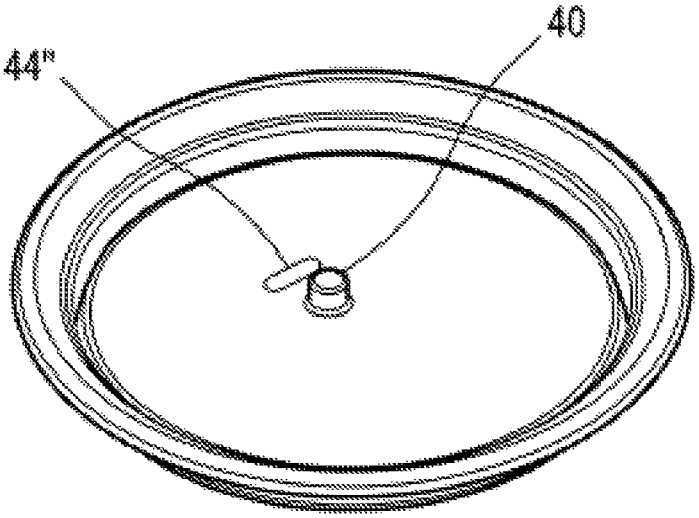

In the embodiment variant according to FIGS. 8*a* and 8*b*, the material-thinning embossment 44' has an elongated shape along a tangent to a circle (not shown), which is concentric with the rivet 40.

Figure 9B:
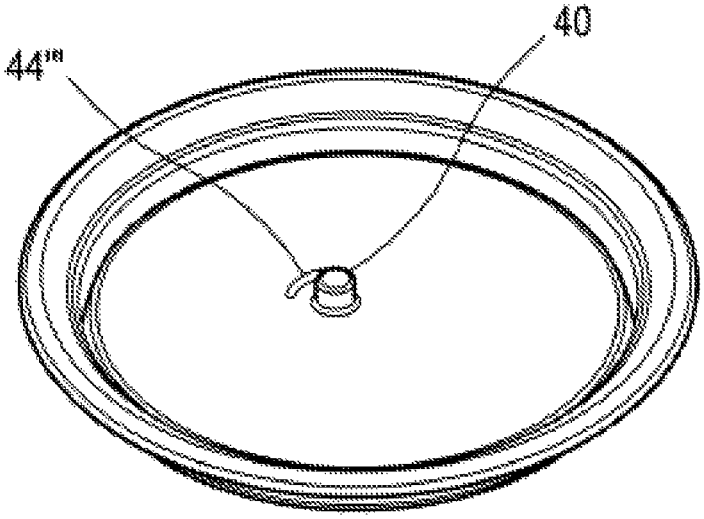

In the embodiment variant according to FIGS. 9*a* and 9*b*, the material-thinning embossment 44''' is an arc section around the rivet 40, i.e., the concave side of the arc section faces the rivet.

Other forms of material-thinning embossment are conceivable, for example, an embossment in a crescent shape resembling the arc-shaped material-thinning embossment 44''''.

In the embodiment shown in FIG. 3, the longitudinal section 46 of the predetermined breaking line 34, along which the predetermined breaking line coincides with the material-thinning embossment 44, runs in a straight line in the direction of a tangent to the circular center line of the material-thinning embossment. However, in the embodiment in FIG. 10*a*, the longitudinal section 46 of the predetermined breaking line 34, which coincides with the circular material-thinning embossment 44, is designed in a curved shape with the concave side facing the rivet. The radius of curvature of the curve is somewhat greater than the radius of the circular center line of the material-thinning embossment 44. The predetermined breaking line 34 exits laterally from the material-thinning embossment at both ends of the longitudinal section 46. In comparison with the embodiment in FIG. 3, this therefore yields a greater length of the coinciding part of the predetermined breaking line 34 with the material-thinning embossment 44, so that the break in the predetermined breaking line can continue more easily to the ends of the longitudinal section 46, after the same is broken open, and can then continue into the remaining sections of the predetermined breaking line.

FIG. 10 shows the trough-shaped cross-sectional contour of the material-thinning embossment 44 at the right of the rivet 40, whereas the superimposed contour 34+44 of the predetermined breaking groove and the material-thinning embossment is shown at the left of the rivet. Due to the greater width and embossing depth of the cross-sectional contour of the predetermined breaking line, the material-thinning embossment has been widened and deepened in the area of overlap by the embossing ram for the predetermined breaking line.

In the embodiment in FIG. 10*a*, the bead and the rivet 40 are arranged at a slight offset from the center of the lid panel toward the breaking-open area 18.

LIST OF REFERENCE NUMERALS

10 Lid
12 Roll
14 Shell
16 Grip tab
18 Breaking-open area
20 Panel
22 Counter sink
24 Chuck wall
26 Peripheral protrusion
28 Grip section
30 Reinforcing recess
32 Reinforcing recess
34 Predetermined breaking line
36 Protrusion
38 Bead
40 Rivet
42 Plateau
44 Material-thinning embossment
46 Longitudinal section of the predetermined breaking line
47 Rivet base
48 Pressing point
49 Bottom surface of the material-thinning embossment
50 Break-open edge

What is claimed is:

1. A lid made of metal, for a beverage can designed for permanent connection to a can body, the lid having a lid panel from which a rivet is shaped and into which a predetermined breaking line, which defines a breaking-open area, is impressed, along which an opening in the lid panel is to be opened by means of a grip tab, which is attached to the rivet and has a break-open edge pressed against a predetermined pressing point of the breaking-open area by raising a grip section of the grip tab when opening up the opening, where in the lid panel has a rivet base around the rivet, in which the metal of the lid is thinner and/or more brittle than in the regions of the lid panel adjacent to the river base, characterized in that the predetermined breaking line runs outside of the rivet base and a material-thinning embossment, which also runs outside of the rivet base and is designed in the form of an embossing recess and is associated with an embrittlement of the thinned-out material, is provided in at least one area of the lid panel situated between the rivet base and the predetermined pressing point of the breaking-open area, wherein a longitudinal section of the predetermined breaking line in this lid panel region coincides with the material-thinning embossment around the longitudinal section, wherein the embossing depth of the predetermined breaking line is greater than the embossing depth of the material-thinning embossment;

wherein the predetermined breaking line is impressed in the material-thinning embossment along the longitudinal section and exists from the material-thinning embossment at the ends of the longitudinal section.

2. The lid according to claim 1, characterized in that the grip tab can be rotated around the rivet in such a way that the grip section of the grip tab can be moved beyond the opening formed by breaking open the predetermined breaking line wherein the grip section is designed for closing the opening.

3. The lid according to claim 1, characterized in that the material-thinning embossment has a greater width, measured in the direction radially to the rivet, then the predetermined breaking line.

4. The lid according to claim 1, characterized in that the material-thinning embossment has a width of 0.6 millimeter to 1 millimeter, measured radially to the rivet.

5. The lid according to claim 1, characterized in that a centerline of the material-thinning embossment is a distance of 4 millimeters from an axis of the rivet.

6. The lid according to claim 1, characterized in that the embossing depth of the material-thinning embossment is 0.03 millimeter to 4.5 millimeters from an axis of the rivet.

7. The lid according to claim 1, characterized in that the material-thinning embossment runs in a curved shape at least partially around the rivet base.

8. The lid according to claim 7, characterized in that the material-thinning embossment runs in a ring shape concentrically around the rivet.

9. The lid according to claim 1, characterized in that the material-thinning embossment runs partially around the rivet in a crescent shape.

10. The lid according to claim 1, characterized in that the material-thinning embossment runs outside of the rivet base tangentially to a circle around the rivet base.

11. The lid according to claim 1, characterized in that the longitudinal section of the predetermined breaking line with which the material-thinning embossment coincides runs in a curved shape with the concave side facing the rivet.

12. The lid according to claim 1, characterized in that the rivet is arranged on a bead, which is elevated with respect to a level of the lid panel and runs around the breaking-open area, while the predetermined breaking line and the material-thinning embossment run at the level of the lid panel.

13. The lid according to claim 1, characterized in that the material-thinning embossment forms a recess on an exterior side (customer side) of the lid facing away from the future interior of the can.

14. The lid according to claim 1, characterized in that the rivet is arranged eccentrically on the lid panel.

15. A method for producing a lid according to claim 1, characterized in that the shaping of the rivet comprises the following steps:

shaping a bubble, a first rivet head shape and a second rivet head shape, wherein the material-thinning embossment is introduced into the lid panel from the exterior side of the lid during the shaping of the second rivet head, the grip tab being subsequently attached to the exterior side (customer side) and then the predetermined breaking line is impressed.

16. The method for manufacturing a lid according to claim 15, characterized in that the material-thinning embossment is created in the lid simultaneously with the predetermined breaking line, wherein the predetermined breaking line is introduced from the side of the lid into its lid panel to which the grip tab is attached subsequently (customer side) while the material thinning embossment is introduced into the lid.

* * * * *